US005324466A

United States Patent [19]

Orino et al.

[11] Patent Number: 5,324,466

[45] Date of Patent: Jun. 28, 1994

[54] METHOD FOR THE PRODUCTION OF MULTI-LAYERED CONJUGATED ACRYLIC FIBERS

[75] Inventors: Shoji Orino; Hiroyoshi Tanaka; Akiteru Kuroda, all of Ehime, Japan

[73] Assignee: Toray Industries, Inc., Japan

[21] Appl. No.: 592,202

[22] Filed: Oct. 24, 1990

Related U.S. Application Data

[62] Division of Ser. No. 162,652, Mar. 1, 1988, Pat. No. 4,999,245.

[51] Int. Cl.[5] ..... D01F 8/08

[52] U.S. Cl. ..... 264/171; 264/182; 264/206; 264/210.7; 264/210.8; 264/211.15; 264/211.16; 264/211.17; 264/233; 264/342 RE

[58] Field of Search ..... 264/171, 182, 206, 210.8, 264/210.7, 233, 211.15, 211.16, 211.17, 342 RE

[56] References Cited

U.S. PATENT DOCUMENTS

| | | | |
|---|---|---|---|
| 3,251,113 | 5/1966 | Gray et al. | 264/171 |
| 3,412,191 | 11/1968 | Kitajima et al. | 264/171 |
| 3,562,378 | 2/1971 | Fujita et al. | 264/171 |
| 3,570,235 | 3/1971 | Fukuhara et al. | 264/171 |
| 3,644,609 | 2/1972 | Nakagawa et al. | 264/171 |
| 3,672,802 | 6/1972 | Matsui | 264/171 |
| 3,864,447 | 2/1975 | Sekiguchi et al. | 264/171 |
| 3,924,045 | 12/1975 | Ogasawara et al. | 264/171 |
| 3,968,307 | 7/1976 | Matsui et al. | 264/DIG. 26 |
| 4,085,174 | 4/1978 | Ishikawa et al. | 264/171 |
| 4,088,431 | 5/1978 | Johnson et al. | 264/211.11 |
| 4,406,850 | 9/1983 | Hills | 264/171 |

*Primary Examiner*—Hubert C. Lorin
*Attorney, Agent, or Firm*—Austin R. Miller

[57] ABSTRACT

A multi-layered conjugated acrylic fiber comprises different acrylic polymers which are conjugated along the fiber axis in layers. On the average the fiber contains more than two layers of acrylic polymers. The shrinkage forming ratio in boiling water of the conjugated acrylic fiber is 7–15% and the shrinkage forming stress is 5–20 mg/denier. To make the acrylic fiber water absorbent, one or more of the acrylic polymers may contain 0.3 to 2.0 mmole/g of carboxylic acid groups. The fibers may be made by introducing the polymers into a static mixer in such a way as to retain a number of separate layers of the polymers, and thence to a spinneret through a filter having a maximum mesh space of 10 or more. After spinning out the dope, it is drawn, washed and dried. Except where water-absorbent fiber is wanted, this is followed by shrinkage forming treatment and redrawing; the water-absorbent fiber is treated with alkali solution either in the form of yarn, or a fabric made therfrom.

7 Claims, 2 Drawing Sheets

METHOD FOR THE PRODUCTION OF MULTI-LAYERED CONJUGATED ACRYLIC FIBERS

This is a division of application Ser. No. 07/162,652, filed Mar. 1, 1998, now U.S. Pat. No. 4,999,245.

TECHNICAL FIELD

The present invention relates to conjugated acrylic fibers.

BACKGROUND ART

Hitherto, as the conjugated fibers obtained by conjugating two or more kinds of acrylic polymer in a bimetal formation (i.e. with the polymers appearing as sectors in a cross-section through the conjugated fiber) or a sheath-core formation through a conjugation spinneret have unique and excellent three dimensional crimps they have been widely applied to such uses as clothing, wadding for bedding and the like.

However, uneven dyeing and peeling is likely to occur owing to the differences in kind and composition of the polymers. Moreover, it is generally necessary to increase the number of crimps for obtaining conjugated fibers having high bulkiness, but the touch of fibers then tends to become hard because the degree of shrinkage does not increase in proportion to the crimp numbers per length. These are the defects of the products based on conjugated fibers.

Furthermore, the spinneret device becomes more expensive as spinneret structures become more complex in spinning technology and it is also especially difficult to produce conjugated fibers of finer denier. Moreover, there has been the problem that only inferior touch far below the touch of wool could be obtained and so on, because the conjugated state of the fibers obtained is too uniform. Against these conventional bimetal type or sheath-core type conjugated fibers, Japanese Laid-Open Patent Applications Nos. 70322/1976 and 75151/1976 proposed a multi-layered conjugated fiber produced by introducing different spinning dopes of acrylic polymers into a static mixer to divide them to form a multi-layered flow and thereafter spinning this flow through a spinneret. It is said that the multi-layered conjugated fibers thereby obtained give spun yarns and their products without occurrence of uneven yarns and with uniform bulkiness.

However, although the multi-layered conjugated fibers thus obtained give improvements in blending and bulkiness to some extent in comparison with the effect of the conventional conjugated fibers, the theoretical number of layer per fiber expressed the statistical average number of inflow dope layers per filament, i.e. caused to flow into each hole of a spinneret are both low, namely 1.0–2.0 and 0.05–0.5 in Japanese Laid-Open Patent Application Nos. 70322/1976 and 75151/1976 respectively, because the unique cross-sectional structures and physical characteristics of the fibers are no longer maintained when division of layers is too high in the static mixer. Therefore, as shown in FIG. 2, fibers consisting of a single component polymer, namely only one component polymer of the conjugated polymers, become included in large quantities in the-conjugated fibers. As a result, because of insufficient multi-layered conjugation of two or more polymer components, there are defects that not only can the required shrinkage characteristics hardly be obtained, but the shrinkage characteristics fluctuate remarkably. This tendency becomes more noticeable with increasing molar ratio difference between copolymer compositions. Moreover, as described above, when the content of single fibers consisting of only one component polymer of the conjugated polymers becomes higher, for example, unevenness of shrinkage characteristics and uneven dyeing occur as a matter of course and further problems still remain in the conventional multi-layered conjugated fibers of the prior art.

The theoretical number of layers per fiber can be expressed as the statistical average number of inflow dope layers caused to flow into each hole of a spinneret. This is a theoretical value of the number of layers being theoretically brought into a single fiber in the region of a perfect laminar flow, and can be calculated by the following equation:

$$\text{Theoretical number of layers per fiber} = \frac{\text{Divided layer numbers in the spinning dope flow}}{K\sqrt{\text{Numbers of holes in the spinneret}}}$$

(where K is a constant determined by the outer shape of the spinneret plate and the value of K is 1 for a rectangular shape and 1.1 for a one with circular shape).

On the other hand, as, for example, Japanese Patent Publication No. 32859/1979 shows, a modified cross sectional acrylic fiber having a shrinking percentage of 15–25% in drying and successive processes can be prepared by spinning an acrylonitrile polymer comprising 95 mole % or more of acrylonitrile and 0.7–2.0 mole % of vinyl monomer containing sulfonic acid groups through a spinneret whose cross-section has three or more protruding portions of an acute or obtuse angle under a spinning draft of 0.9–1.5.

However, the conventional modified cross-sectional fibers display various unsolved problems described below, which have not yet been solved. Thus, their mechanical properties, especially tensile strength and elongation and knot strength, are lower than those of ordinary acrylic fibers and flies and fluffs therefore very often occur in the spinning process. There is moreover another problem peculiar to the modified cross-sectional fibers that if the composition is modified to try to solve this problem, color deepness after dyeing becomes insufficient owing to insufficiency of denseness and luster. Moreover, there is the further problem that bulkiness of the modified cross-sectional fibers cannot reach a sufficiently satisfactory level;

As an example of an attempt to give water absorbent property to acrylic fibers, Japanese Laid-Open Patent Application No. 139510/1982 discloses that water absorbent property can be given to acrylic fibers by treating acrylic fibers containing a carboxylic acid component with boiling aqueous alkali solution.

However, there are problems in the conventional water absorbent acrylic fibers, in that the mechanical strength after giving water absorbent property (ordinary alkali treatment) is lower in comparison with that of the ordinary acrylic fibers, the dyeing property is insufficient, stickiness to the touch after water absorption is large and moreover, because it is difficult to give appropriate crimps to water absorbent acrylic fibers, it is therefore difficult to obtain a bulky touch.

Pilling-resistant acrylic fibers are well known. However, it has been difficult to obtain pilling-resistant acrylic fibers having good balance of dyeing property, bulkiness and knot strength after treating with boiling water.

SUMMARY OF THE INVENTION

The object of the present invention is to provide conjugated acrylic fibers which have a good balance of desirable properties of such fibers, that is to say

- considerable bulkiness and soft touch to products made therefrom
- good level dyeing property
- bulkiness retention
- good mechanical properties such as tensile strength and elongation, knot strength and so on A further object of the invention in one of its aspects is the provision of a water absorbent conjugated acrylic fiber with good properties as regaers mechanical strength, coalescent property, absence of clamminess to the touch, dyeing capability and bulkiness.

A multi-layered conjugated acrylic fiber according to the present invention comprises different acrylic polymers, these polymers being conjugated along the fiber axis in more than 2 layers on the average, the shrinkage forming ratio in boiling water of the conjugated acrylic fiber being 7–15%, and the shrinkage forming stress in dry heat being 5–20 mg/denier. Where such a conjugated acrylic fiber is to be water absorbent, then at least one of the acrylic polymers may be an acrylic polymer containing 0.3 to 2.0 mmole/g of carboxylic acid groups, giving the conjugated acrylic fiber a water retention ratio of 50–500 weight %.

A method for the production of a multi-layered conjugated acrylic fiber according to the invention comprises dividing two or more spinning dopes of acrylic polymers into layers wherein theoretical number of layers per fiber defined by the following equation is 3–30

$$\text{Theoretical number of layers per fiber} = \frac{\text{Divided layer numbers in the spinning dope flow}}{K\sqrt{\text{Numbers of holes in the spinneret}}}$$

(where K is a constant determined by the outer shape of the spinneret plate and the value of K is 1 for a rectangular shape and 1.1 for a one with circular shape).

REFERENCE TO DRAWINGS

The accompanying drawings illustrate embodiments of the conjugated acrylic fibers of the present invention, and the method of manufacture by the drawings FIG. 1 shows a cross-sectional photograph of one form of multi-layered conjugated fibers of the present invention;

DETAILED DESCRIPTION OF EMBODIMENTS

Figure 1:
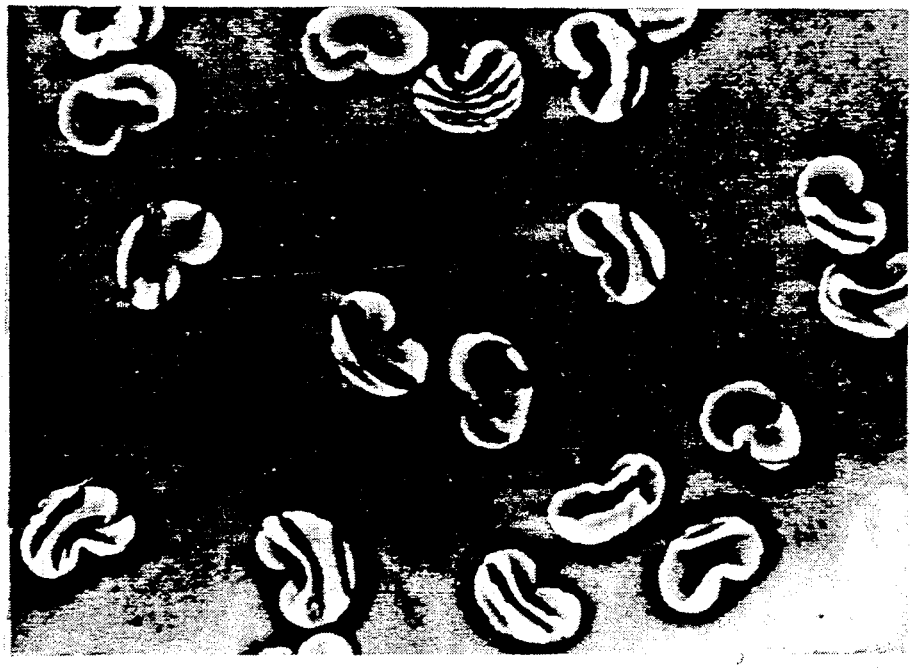
Figure 2:
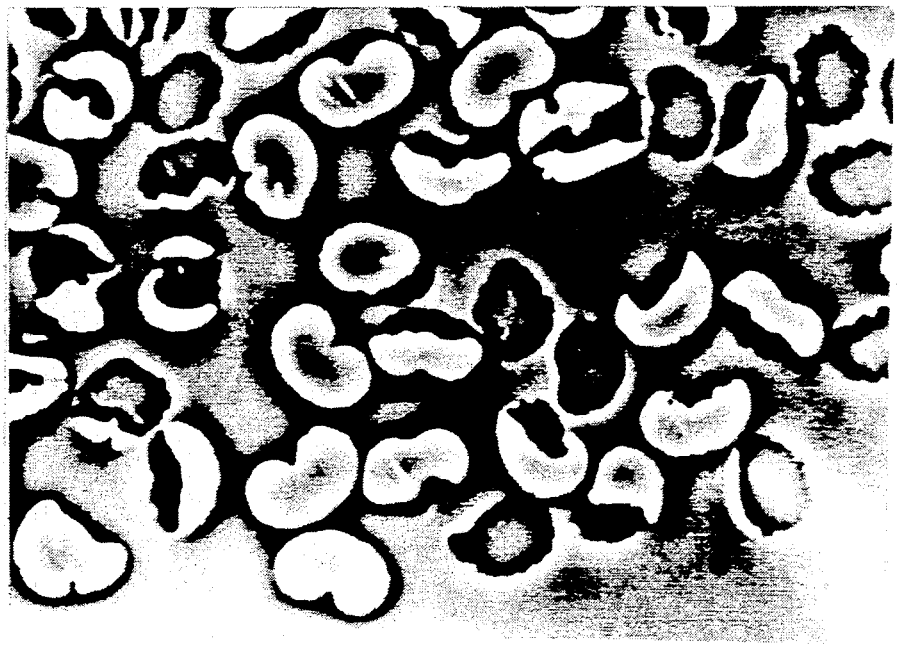
FIG. 2 shows a cross-sectional photograph of conventional multi-layered conjugated fibers.
Figure 3:
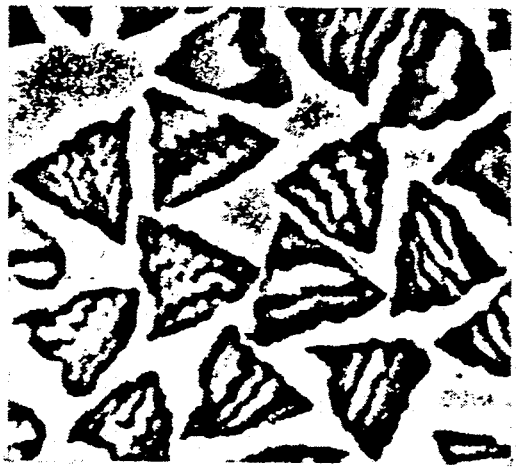
FIG. 3 shows a cross-sectional photograph of another form of fibers of the present invention.

As illustrated by the cross-sectional views of FIGS. 1 and 3, the conjugated acrylic fibers of the present invention form a multi-layered structure—that is to say, the two or more polymer components are distributed in layers forming an asymmetrical continuous structure along the fiber axis. The multi-layered structure of the present invention is quite different from the structure of the conventional conjugated fibers having bimetal structures or sheath-core structures.

In these multi-layered conjugated fibers, potential shrinkage power for forming three dimensional crimps (i.e., shrinkage forming stress) comes out by shrinkage forming treatment and re-drawing treatment as described later.

The acrylic polymers forming the conjugated acrylic fiber of the present invention obviously have different compositions even if the monomers are the same. However the physical characteristics should not be too greatly different. Specifically in the case where the acrylic polymers are essentially made from the same two monomers, if the propotions of the major monomer component and of the comonomer are expressed in mole then the maximum difference in the molar ratios of the comonomer (the copolymerisable component) should not be more than 10 as between the polymers. Equally however, as will be understood by those skilled in the art, the compositions of the acrylic polymers must differ sufficiently for the conjugated acrylic fiber to display the required characteristics. In consequence the mole percentage figure of the comonomer (or the maximum mole percentage if there are more than two polymers) can be expected to differ by at least one unit as between the polymers.

Even where the difference between the molar ratios of the copolymers is approaching the upper limit, occurence of unevenness of shrinkage characteristics can be sufficiently avoided. Moreover, coloring property after dyeing, denseness, luster, tensile strength and elongation, knot strength and so on of said conjugated fibers can be improved in larger degree than estimated. Moreover, by making multi-layered conjugation of a water absorbent acrylic polymer and a conventional acrylic polymer, not only does the multi-layered conjugation very effectively act for keeping mechanical strength of fibers after water absorbent treatment, but coalescence among fibers and clammy touch after water absorption disappears.

To prepare multi-layered conjugated fibers, one component polymer among two or more component polymers is laminated with the other component polymers to form a continuous structure along the fiber axis direction with the average numbers of the layers amounting to 2 or more, preferably 4–15 layers.

Ideally, all fibers should be constituted of single fibers having the above described multi-layered conjugated structure, but in pratice all the single fibers constituting the fibers have not necessarily the above described conjugated structure and it is desirable that fibers having sufficiently excellent shrinkage characteristics should be prepared by selecting and specifying theoretical number of layers per fiber for conjugated polymer components in a static mixer and aftertreatment conditions of the fibers obtained.

It is necessary that the fibers of the present invention have a good balance of properties, and in particular the shrinkage forming ratio and the shrinkage forming stress should be in the ranges of 7–15% and 5–20 mg/d respectively. The reasons are as follows. If the shrinkage forming ratio of said fibers is smaller than 7% and the shrinkage forming stress is smaller than 5 mg/d, bulkiness of the fiber products prepared from said fibers is not sufficient and this is a fatal defect in the characteristics of the products. On the other hand, if the shrinkage forming ratio is larger than 15% and the shrinkage forming stress is larger than 20 mg/d, touch of the products becomes harder and it is not desirable. Especially, in the case of modified cross-sectional fibers, this is not desirable that touch of the products, especially the linen like dry touch which is a essential characteristic of the modified cross-sectional fibers, is spoiled. Moreover, if the shrinkage forming ratio and shrinkage forming stress are within the ranges given, the degree of level dyeing of said fibers is also remarkably improved and the liability to uneven dyeing which is found in the conventional multi-layered conjugated fibers and bimetal type conjugated fibers can be remarkably reduced.

Furthermore, it is desirable that shrinkage forming retention property of the fibers of the present invention is 30% or more, preferably 50% or more. Then, for example, in a dyeing process where the fibers in a spun yarn are being restricted by a force, sufficient degree of crimps can be formed and it is thereby possible to keep the bulkiness of the products sufficient and stable and to make the touch soft.

Moreover, it is also desirable that the shrinkage ratio in boiling water (treated with boiling water of 98° C. or higher for 20 minutes) is about 5% or less to keep a required bulkiness retention and touch of the fibers of the present invention.

The shrinkage forming ratio in boiling water, the shrinkage forming stress and the shrinkage forming retention property are defined as follows.

Shrinkage Forming Ratio

A sub-tow of 2,000 denier and A in length loaded with a load of 0.4 mg/d (0.8 g) is treated in boiling water (98° C.×2.0 minutes), cooled, dried (65° C.×60 minutes) and the length of the sub-tow is thereafter measured (the measured length is B). The shrinkage forming ratio is calculated by the following equation.

$$\text{Shrinkage forming ratio}(\%)=\{(A-B)/A\}\times 100$$

A: Length of the original sample
B: Length after treatment

Shrinkage Forming Stress

A 4-count roving yarn is prepared of the sample fibers. This yarn is set in a loop-like shape on a shrinkage stress tester manufactured by Kanebo Co., Ltd. and an initial load of 1 mg/d is loaded thereon. The temperature is elevated from room temperature and the shrinkage forming stress is measured at 140° C. under dry state.

Shrinkage Forming Retention Property

A sub-tow of 2,000 denier and A in length loaded with a load of 0.2 mg/d (0.4 g) is treated in boiling water (98° C.×20 minutes), cooled, dried (65° C.×60 minutes) and the length of the sub-tow is thereafter measured (the measured length is B). The shrinkage ratio ($\Delta S_1$) is calculated by the equation (I).

$$\Delta S_1(\%)=\{(A-B)/A\}\times 100 \quad \text{(I)}$$

A: Length of the original sample
B: Length after treatments

On the other hand, a sub-tow of 2,000 denier and A in length loaded with a load of 1.5 mg/d (3 g) is treated in boiling water (98° C.×20 minutes), cooled, dried (65° C.×60 minutes) and the length of the sub-tow is thereafter measured (the measured length is C). The shrinkage ratio ($\Delta S_1$ is calculated by the equation (II).

$$\Delta S_2(\%)=\{(A-C)/A\}\times 100 \quad \text{(II)}$$

A: Length of the original sample
B: Length after treatment

The shrinkage forming retention property is calculated by the following equation using $\Delta S_1$ and $\Delta S_2$ thus obtained.

$$\text{Shrinkage forming retention property} = \frac{\Delta S_2}{\Delta S_1} \times 100(\%)$$

The fibers of the present invention whose shrinkage forming retention property is 30% or more exhibit uniform bulkiness by bulkiness forming treatment regardless of the restricting force in spun yarns.

When the cross-sectional shape of the fibers of the present invention is a modified cross-section having two or more protruding portions of acute or obtuse angle, concretely, a polygon such as tri-, tetra-, penta- or hexagon, star-, T-, Y- or H- shape or flat-shape with two peaked ends, are desirable fiber products having linen-like dry touch and bulkiness can be prepared.

On the other hand, water absorbent acrylic multi-layered conjugated fibers are prepared by water absorbent treatment of a carboxylic acid group containing acrylic polymer with alkali. aqueous solution to make it hydrophilic and crosslinked; and in this treatment the ordinary acrylic polymer component is not influenced by the alkali and therefore can keep a required mechanical strength. Moreover, the multi-layered structure of the fibers of the present invention exhibits improved dyeing property and it is possible to form crimps appropriate to a bulky touch by controlling the difference in shrinking characteristics among polymer components (especially in alkali solution).

To prepare the fibers of the present invention having enough water absorbent characteristics, stable spinning characteristics and no coalescence among single fibers after alkali treatment, it is preferable that the content of carboxylic acid in the carboxylic acid containing acrylic polymer of the fiber is in the range of 0.3–2.0 mmole/g. It is also preferable that the water retention ratio of said fibers is in the range of 50–500 weight %.

In the present invention, carboxylic acid content per fiber weight and water retention ratio are defined as follows.

Carboxylic Acid Content Per Fiber Weight (mmole/g)

About 1 g of the sample having been completely dried is accurately weighed (A g), and 200 ml of water is added therein. 1N hydrochloric acid aqueous solution is added into the mixture under heating at 50° C. to make the pH 2 and a titration curve is obtained by using 0.1N sodium hydroxide aqueous solution in the usual way. The quantity of sodium hydroxide aqueous solution consumed to neutralize the carboxylic acid groups (B ml) can be obtained from this titration curve. The carboxylic acid content is calculated by the following equation from the above described measured results.

$$\text{Carboxylic acid content (mmole/g)} = \frac{0.1\,B}{A}$$

Water Retention Ratio

The sample fibers are cut into about 50–70 mm in length and about 3 g thereof are immersed in water at 25° C. for 1 hour. Thereafter, the fibers are put into a polyester filter cloth (200 mesh) and water between fibers is removed by means of a centrifugal dehydrator (inner diameter 180 mm) under rotation of 3,500 rpm.

The weight of the sample thus prepared ($W_1$) is measured. Next, said sample is dried to constant weight in a vacuum drier at 80° C. and the weight ($W_2$) is measured. The water retention ratio is calculated by the following equation from the above described measured results.

$$\text{Water retention ratio}(\%) = \frac{W_1 - W_2}{W_2} \times 100$$

To give good spinning property and pilling resistance to the fibers of the present invention, it is preferable that the knot strength after boiling water treatment is in the range of 0.8–1.9 g/d.

Next, examples for preparation of the fibers of the present invention are described.

As the acrylic polymers of the present invention, acrylic polymers known in the prior art, namely, modacryl polymers containing 35 mole % or more of acrylonitrile, acrylic polymers containing 80 mole % or more of acrylonitrile and their copolymers can be used and no special limitation exists. However, in selecting two or more polymers fabricated from two monomers as the conjugated polymers of multi-layered conjugated fibers, it is preferable for obtaining good shrinkage characteristics and level dyeing property that the maximum difference in the molar ratios of the copolymer components experssed as molar percentages should be 1–10 and preferably. When the copolymer components is two, the maximum difference in the quantities of the copolymer components is equal to the difference in the quantities of the copolymer components. If this maximum difference in the quantities of the copolymer components is less than 1 mole %, shrinkage forming characteristics in boiling water tend to become low and if this value is more than 10 mole %, undesirable problems tend to occur, such that level dyeing property of the fiber becomes poor and the shrinkage forming characteristics appropriate to good touch of the products cannot be obtained.

As the copolymerizable components of these acrylic polymers, there can be used vinyl compounds such as acrylic acid, methacrylic acid, their lower alkyl esters, itaconic acid, acrylamide, methacrylamide, vinyl acetate, vinyl chloride, styrene, vinylidene chloride and various acidic monomers including unsaturated sulfonic acids such as vinyl sulfonic acid, allyl sulfonic acid, methallyl sulfonic acid, p-styrene sulfonic acid and salts thereof.

Moreover, if about 1–10 weight %, preferably 2–5 weight % based on the total polymers, of acrylonitrile-styrene copolymer, cellulose acetate or methyl methacrylate type polymers coexist with said acrylic polymer, a microporous structure can be formed in the fibers obtained, which exhibits higher water absorbent characteristics.

The above described acrylic polymers are suitably dissolved in organic solvents or inorganic solvents such as dimethylformamide, dimethylacetamide, dimethylsulfoxide, rhodanides of alkali metal such as lithium rhodanide, potassium rhodanide and sodium rhodanide, ammonium rhodanide, zinc chloride and salts of perchloric acid to prepare spinning solutions whose polymer concentrations are about 10–25 weight %. Two or more polymer spinning solutions to be conjugated can be supplied to a static mixer to divide them into layers and fibers are thereafter prepared by either a wet spinning process where the solution is extruded in a coagulation bath through usual spinneret holes or a dry jet wet spinning process where the solution is first extruded into air or an inert gas atmosphere through said spinneret holes and then brought into a coagulation bath.

Figure 4:
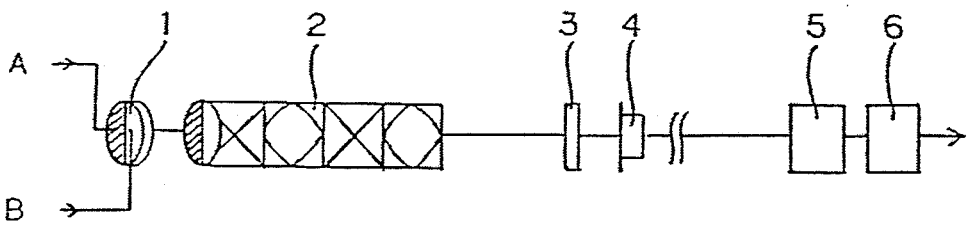
FIG. 4 shows a flow sheet illustrating process conditions in the spinning process stage of a process according to the present invention.

An embodiment of the spinning process of the present invention will now be distributed in more detail by reference to FIG. 4 which is a flow sheet illustrating each step of the spinning process for the fibers. In this figure, A and B are spinning solutions of conjugated polymers, 1 a guiding device to pour separately each spinning solution of conjugated polymers, 2 a static mixer, 3 a filter, 4 a spinneret, 5 a fiber shrinkage forming equipment, 6 a redrawing equipment to remove once the crimps formed by the fiber shrinkage forming equipment 5 by drawing the shrunk fibers. The points to which attention should be especially paid are above all to divide inflow dope layers sufficiently by means of a static mixer and to keep stably the divided multi-layered structure thus obtained to the spinneret.

To divide inflow dope layers sufficiently in a static mixer the layers should be divided so that theoretically same 3–30, preferably 4–15, layers are to be formed in each fiber and are in consequence forwarded on average to each hole of the spinneret.

The theoretical number of layers per fiber can be properly controlled by the structure in a static mixer, such as the number of lamination stages and arrangement of mixing elements, and the twist angle of twisted blades, as well as the number of path tubes and the number of holes of the spinneret.

Keeping the theoretical number of layers per fiber within this range, coupled with the below described shrinkage forming and redrawing, remarkably improve the above described shrinkage characteristics of the fibers obtained; and the problems of conventional conjugated fibers, especially the trend that the touch becomes harder with increase in the shrinkage forming numbers and insufficient bulkiness retention property can be solved simultaneously and moreover, fibers having excellent level dyeing property can be obtained.

However, theoretical number of layers per fiber do not always coincide with the average layer numbers of multi-layered conjugated fibers and the values of the latter are ordinarily smaller than the values of the former. The reason is not clear, but it is estimated that the practical condition deviates from the laminar flow region and a recovering force acts on the spinning dope flow twisted to a specified angle.

Next, to form a stable multi-layered structure of spinning dopes of conjugated polymers in a static mixer, it is desirable that the difference in the viscosities among these spinning dopes be 50 poises or less at 60° C. By making the viscosity difference 50 poises or less, the stream lines in the static mixer are hardly disturbed and the divided and distributed multi-layered structure becomes more stabilized. In this case, the Reynolds number is small in the static mixer and it is 0.2 or less.

In the case of dry jet wet spinning, to prevent dripping of the spinning solution from the spinneret when it is spun, it is desirable that the viscosity of the dope is about 400 poises or more when extruded from the spinneret, preferably 800 poises or more, that is, it is kept as high as possible.

When the spinning dopes to be conjugated are supplied into a static mixer, they are preferably not first joined together and thereafter supplied into the mixer; it is on the contrary desirable that the spinning dopes be independently supplied into the static mixer; by using a spinning dope guiding device set at an inlet of the static mixer as shown in FIG. 4 in such a way that the spinning dopes of conjugated component polymers are not mixed with each other. The inflow means for spinning dopes like this is quite different from the effect brought about by simply decreasing one mixing element and it makes forming a multi-layered structure in a static mixer much more sure and stable.

Figure 5:
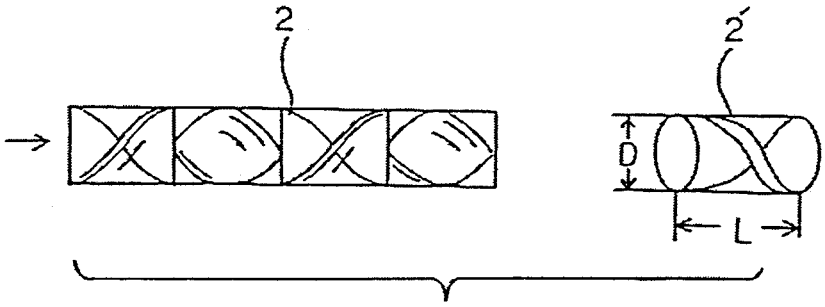
FIG. 5 shows a rough sketch of mixing elements of a static mixer.

As shown in FIG. 5, it is preferable that the pitch (L/D) of a mixing element of the static mixer is in the range of 0.8–2.5, especially 1.4–2.0 to make the multi-layered stream lines of spinning dopes in the static mixer less disturbed and therefore to make the multi-layered state much more stable.

As the static mixers used in this case, for example, "Hi-mixer" manufactured by Toray Industries, Inc., "Static mixer" manufactured by, Horitake Co., Ltd., "Square mixer" manufactured by Sakura Seisaktislio Co., Ltd. and "Ross ISG mixer" manufactured by Tokushu Chemical Engineering Machines Co., Ltd. can be listed.

Among these mixers for forming multi-layers, preference is expressed for "Static mixer" and "Square mixer" in which the constituent elements are not complicated, flow resistance of spinning dopes is relatively small, and the effective cross-sectional area in the path of spinning dopes is more constant, in other words, abnormal stagnation of spinning dopes hardly occurs in the apparatus.

Spinning dopes divided into multi-layers of a specified range in the above described static mixer are guided into an usual spinneret, that is to say, not a spinneret for conventional conjugated fibers (for example, bimetal or sheath-core type). Between the static mixer and the spinneret is located a specific filter, namely a filter with a maximum mesh space of 10 μm or more, preferably 20–50 μm. The smaller the maximum mesh space of this filter, the more the filtering effect or the spinnability of the spinning dopes is improved, but on the contrary, the less the layer division performed in the preceding static mixer is held due to the mixing or disturbing effect in the filter. Therefore, the maximum mesh space must be 10 μm or more.

As the materials of this filter, lattice-shaped materials such as plain gauge fabrics made of polyester or polyamide fibers and wire nets made of stainless steel are preferably used for preventing the above described mixing or disturbing after dividing into layers.

The above described spinning dope having been passed through the filter is spun out from the spinneret—not a spinneret for conventional conjugated spinning, but a normal spinneret having round holes or modified shape holes—and is coagulated in a coagulation bath in which an aqueous solution of the above described organic or inorganic solvents is used as coagulating agent. The coagulation bath in this case usually consists of the above described polymer solvent and water. To obtain an appropriate coagulating speed, the solvent concentration in the coagulation bath is usually about 10–85%, preferably 30–75% and the temperature of the coagulation bath is usually about 0°–50° C., preferably 5°–40° C.

In this case, the polymer solution having been spun out from the spinneret may be either introduced directly into a coagulation bath (wet spinning process) or first passed through a space of some 2–20 mm between the spinneret and the surface of the coagulation bath (dry jet wet spinning process). Moreover, the fibers of the present invention can be prepared by means of a dry jet spinning method, too.

The coagulated filaments guided out from the coagulation bath are either (i) washed with water, (ii) washed with water and drawn at the same tune, (iii) drawn and thereafter washed with water, or (iv) washed with water and thereafter drawn; and are thereafter dried and thus densified. In the process of the present invention, it is essential to carry out a shrinkage forming treatment and a redrawing treatment after this drying and densification. Except, in the case of obtaining water absorbent acrylic conjugated fibers, when it is not essential to carry out said shrinkage forming and redrawing treatments as described below.

The shrinkage forming treatment is carried out with steam heating under relaxed condition and it is desirable that the steam heating temperature is 105° C. or more, especially 108°–125° C. or more. By using this steam heating treatment, shrinkage of fibers can be sufficiently effected.

The redrawing treatment is carried out to make the crimps formed by the preceding shrinkage forming treatment to be latent again; it is desirable that the redrawing is carried out at a temperature lower than the heat treating temperature of the above described shrinkage forming treatment and usually a wet heating or steam heating at 80°–115° C. and a draw ratio of 1.05–1.25 are used to make the crimps latent.

As described, besides the above described multi-layered structure formation of conjugated polymers, combination of the shrinkage forming treatment and the redrawing treatment (making the crimps latent) can further improve for the first time the shrinking characteristics of multi-layered conjugated fibers, especially shrinkage power of said fibers for forming three dimensional crimps at the stage of making textile products.

Meanwhile, to obtain water absorbent fibers of the present invention, without the above described shrinkage forming treatment and redrawing treatment, water absorbent fibers having excellent shrinkage characteristics can be obtained by the below described alkali treatment and hot water treatment. Multi-layered conjugated fibers in which at least one acrylic polymer contains carboxylic acid groups can be treated with alkali at any stage, such as in the form of filament, yarn or knitted and woven fabrics. In this case, weak acid salts of alkali metals and alkali earth metals such as sodium carbonate, sodium bicarbonate, sodium acetate, potassium carbonate, potassium bicarbonate, potassium acetate, calcium carbonate, calcium bicarbonate, and calcium acetate can be used as the alkali. Among them, sodium carbonate aqueous solution is suitable for obtaining fibers having the desired good water absorbent property and shrinkage characteristics with proper reaction speed of hydrophilic and cross-linking formation and without any decrease in physical properties or any coalescence. It is preferable that the concentration of sodium carbonate aqueous solution is about 1–100 g/l and the treating temperature is about 70°–100° C. It is more preferable that the concentration is 5–50 g/l and the treating temperature is 85°-100° C. To obtain more effectively the fibers of the present invention, it is desirable that the alkali treatment is carried out under a stretched condition. It is also desirable that the fibers treated with alkali are boiled in hot water at 70°-100° C. for 1 minute or more, preferably 3-10 minutes after washing the fibers with water.

Meanwhile, uniformity of dyeing, numbers of crimps per unit length after boiling water treatment, degree of shrinkage, relative standard deviation of numbers of crimps per unit length, smoothness of surface of single fibers, density, luster, coloring property (K/S), bulkiness and touch are evaluated as follows.

Uniformity of Dyeing

The control fibers and the fibers to be tested are dyed in a same dyeing bath at 100° C. for 60 minutes by using a package dyeing machine with the following three dyes having different dyeing velocities.

| Dyeing conditions: | |
|---|---|
| Astrazon Golden Yellow GL | 1.0% owf |
| Maxilon Red | 0.5% owf |
| Malachite Green | 0.22% owf |
| Cathiorgen L | 0.5% owf |
| Sodium acetate | 0.5% owf |
| pH = 4 | |

2 g of each dyed fiber bundle are taken and are cut in 102 mm length. Differences in color tone and color concentration of opened wads made of the cut fiber bundles are judged by eye under daylight condition to the nearest 0.2 on a scale and the differences of dyeing between the maximum and the minimum values in color tone and color concentration are evaluated as uniformity of dyeing. No difference of dyeing is the best and if the value becomes 2.0 or more, it becomes in pratice a product to be rejected as uneven dyeing within the fiber bundle.

Here, the control fibers are the fibers obtained by spinning a almost complete mixture of plural spinning dopes prepared by polymers having different copolymer composition under the same fiber making conditions as those for the fibers of the present invention.

Numbers of Crimps Per Unit Length after Boiling Water Treatment and Degree of Shrinkage These values are measured by JIS L 1015. Relative standard deviation of numbers of crimps per unit length expressing the dispersion of numbers of crimps per unit length is calculated by the following equation.

$$\text{Relative standard deviation of numbers of crimps per unit length(\%)} = \frac{\sigma}{\bar{X}} \times 100$$

$\sigma$: Standard deviation
$\bar{X}$: Mean value

Smoothness of the Surface of a Single Fiber

Convex-concave ruggedness of the surface of the fiber is observed and evaluated by means of an optical microscope (300 magnification).

◎: Highly smooth
○: Smooth
X: Poorly smooth

Denseness

Fibers are put in cedar oil and the density is judged by naked eye. The fibers having good density become transparent and invisible. On the other hand, the fibers having poor density become white.

Luster

Sensuous evaluation is carried out for evaluating luster.

Coloring property (K/S):

Dye is adsorbed on opened fibers under the following dyeing conditions by using a temperature elevating dyeing machine.

| Dyeing conditions; | |
|---|---|
| Dye Cathilon Blue GRL | 0.5% owf |
| Cathiorgen AN Super | 1.5% owf |
| Sodium acetate | 0.5% owf |
| pH = 4 (adjusted with acetic acid) | |
| Bath ratio | 1:100 |
| Dyeing temperature and time | |

Temperature is elevated up to 98° C. for 60 minutes and dyeing is carried out at 98° C. for 60 minutes after which the fibers are slowly cooled.

Dyed fibers thus obtained are sufficiently opened after drying and the reflectivity (R) at 640 nm wavelength is measured by means of Hitachi self-recording spectrometer. The coloring property (K/S) is calculated by the following equation.

$$K/S = \frac{(1-R)^2}{2R}$$

Bulkiness

The fibers to be tested are opened and then treated with boiling water (100° C.×20 minutes) to make the fibers bulky. Alter drying them, sensuous evaluation (touch) is done on them.

Touch

A 4-count roveing yarn are prepared of fibers to be tested. These roves are treated in steam (100° C.×10 minutes) to make them bulky and bulkiness, recovery rate against compression, sliminess, soft touch and linen-like dry touch are evaluated in the following five stages by sensuous evaluation after drying.

◎ highly excellent
○ good
Δ relatively good
× poor
×× very inferior

The present invention will be more concretely explained by the following examples to be described below.

EXAMPLE 1

94.2% mole of acrylonitrile, 5.5 mole % of methyl acrylate and 0.3 mole % of sodium methallyl-sulfonate were solution-polymerized in DMSO (dimethylsulfoxide) to prepare a spinning dope (A) whose viscosity was 130 poises/60° C. and polymer concentration was 22.5 weight %.

On the other hand, 91.2 mole % of acrylonitrile, 8.5 mole % of methyl acrylate and 0.3 mole % of sodium methallyl-sulfonate were solution-polymerized in the same way to prepare a spinning dope (B) whose viscosity was 125 poises/60° C. and polymer concentration was 22.3 weight %.

Temperatures of the above described two types of spinning solutions (A), (B) were adjusted to 30° C. and equal quantities thereof were guided to a "Static mixer" (pitch of the mixing element L/D is 1.5) equipped with a guiding device 1 at a spinning dope inlet hole as shown in FIG. 4 and thereby divided into inflow dope layers, which were then spun out from a normal rectanglar spinneret plate having round holes of 0.065 mmϕ diameter through a filter prepared of a polyester plain gauge fabric (maximum mesh space about 30 μm) placed just before the spinneret into a coagulation bath consisting of DMSO 55 weight % aqueous solution to coagulate them. In this example, theoretical number of layers per fiber as shown in Table 1 could be obtained by properly adjusting laminated stage numbers of the mixing elements and numbers of holes of the spinneret. The spinning draft was 0.5 and the take-up speed of the coagulated filaments (the spinning speed) was 10 m/minute in this example. The coagulated filaments were drawn by 6.5 times in hot water at 98° C. and the drawn filaments were then dried to densify them at 160° C. after washing them with water at 40° C. These dried and dense filaments were successively treated under relaxed state in steam heating at 113° C. to cause shrinkage.

Next, the crimps were removed by redrawing these shrunk filaments by 1.15 times at 102° C. of steam heating temperature whereafter mechanical crimps of about 11 peaks/25 mm were given to the filaments by means of a pushing-in type crimper and the filaments were dried by hot air (70° C.) to obtain acrylic multi-layered conjugated fibers of 3 denier.

Shrinkage forming ratio in boiling water, shrinkage forming stress in dry heating, uniformity of dyeing, numbers of crimps per unit length after treating in boiling water, degree of shrinkage, relative standard deviation of numbers of crimps per unit length and touch of the fibers thus obtained were evaluated and are shown in Table 1.

For comparison, conjugated fibers whose single filament denier was 3 were prepared under the same conditions as those for the above described example, except for using a spinneret for conventional bi-metal type conjugated fibers and the shrinkage forming ratio in boiling water, shrinkage forming stress in dry heating, uniformity of dyeing, numbers of crimps per unit length after treating in boiling water, degree of shrinkage, relative standard deviation of numbers of crimps per unit length and touch of the fibers are also shown in Table 1 in parallel.

As these results show, fibers of the present invention having a multi-layered structure whose layers were above 2 in average and asymmetric along the fiber axis exhibited good uniformity of crimps, excellent touch (bulkiness and soft touch) and good level dyeing property.

On the other hand, multi-layered conjugated fibers spun under the condition that the theoretical layer numbers of single fibers were less than 3 exhibited larger unevenness of formed crimps because the average layer numbers were 2 or less. The balance of shrinkage forming characteristics was therefore poor and touch was also poor. Of course, unevenness of dyeing was large, too.

TABLE 1

| Sample No. | Theoretical number of layers per fiber | Numbers of divided layers of inflow spinning flow (Layer) | Numbers of holes of spinneret | Shrinkage forming ratio (%) | Shrinkage forming stress (mg/d) | Shrinkage forming after boiling water treatment: Numbers of crimps (number/25 mm)/ Degree of shrinkage (%) | Shrinkage forming after boiling water treatment: Relative standard deviation of numbers of crimps (%) | Uniformity of dyeing | Touch: Bulkiness | Touch: Soft touch |
|---|---|---|---|---|---|---|---|---|---|---|
| 1 | 0.1 | 16 | 17,000 | 3.8 | 2.1 | 8.1/14.9 | 76 | 9 | X X | X |
| 2 | 0.7 | 128 | 34,000 | 5.4 | 2.3 | 11.2/21.4 | 48 | 4 | X | Δ |
| 3 | 1.4 | 256 | 34,000 | 8.1 | 4.2 | 13.6/28.5 | 39 | 2.5 | Δ-X | Δ-○ |
| 4 | 2.8 | 512 | 34,000 | 9.8 | 4.6 | 14.5/29.5 | 30 | 1.0 | Δ | ○ |
| 5 | 3.9 | 512 | 17.000 | 10.2 | 6.7 | 15.0/30.3 | 18 | 0.5 | ○-◎ | ○ |
| 6 | 5.6 | 1024 | 34,000 | 13.5 | 10.1 | 15.5/31.2 | 11 | 0.5 | ◎-○ | ○ |
| 7 | 11.1 | 2048 | 34,000 | 12.4 | 10.1 | 13.8/29.5 | 9 | 0.5 | ○-◎ | ○-◎ |
| 8 | 22.2 | 4096 | 34,000 | 11.6 | 9.7 | 12.0/23.3 | 9 | 0.2 | ○-Δ | ○-◎ |
| 9 | (Bimetal type conjugated fibers) | | 20,000 | 5.8 | 4.5 | 31.8/37.4 | 18 | 2.5 | ○ | X X |

EXAMPLE 2

In the conditions of Example 1, the solution viscosity of spinning dope (A) was varied by controlling polymerization time and polymer concentration used in its preparation in order to vary the difference in solution viscosity between the spinning dopes (A) and (B) as shown in Table 2. Other conditions were the same as those of Example 1 to obtain acrylic multi-layered conjugated fibers whose denier of single fiber was 3 denier (however, in this case, theoretical number of layers per fiber were 5.6).

Shrinkage forming ratio in boiling water, shrinkage forming stress in dry heating, uniformity of dyeing, numbers of crimps per unit length after treating in boiling water, degree of shrinkage, relative standard deviation of numbers of crimps per unit length and touch of the fibers obtained were shown in Table 2, Sample 1 being equivalent to Sample 6 of Table 1.

EXAMPLE 3

In the conditions of Example 1, when 2 types (A) and (B) of spinning dopes were divided into inflow dope layers and spun out into a coagulation bath from a spinneret through a stainless steel wire filter to prepare coagulated filaments, the maximum mesh space of said filter was changed as shown in Table 3. Other conditions were the same as those of Example 1 to obtain acrylic multi-layered conjugated fibers whose denier of single fibers was 3 denier (however, in this case, theoretical number of layers per fiber were 5.6).

Spinnability and shrinkage forming ratio in boiling water, shrinkage forming stress in dry heating, uniformity of dyeing, numbers of crimps per unit length after treating in boiling water, degree of shrinkage, relative standard deviation of numbers of crimps per unit length and touch were shown in Table 3.

As these results showed. there were remarkably large differences in bulkiness and touch of the fibers obtained when the maximum mesh space of the filter placed just before a spinneret was 10 μm or more or less than 10 μm.

TABLE 2

| Sample No. | Difference in viscosities of spinning dopes (Poises/60° C.) | Shrinkage forming ratio (%) | Shrinkage forming stress (mg/d) | Shrinkage forming after boiling water treatment: Numbers of crimps per 25 mm/ Degree of shrinkage (%) | Shrinkage forming after boiling water treatment: Relative standard deviation of numbers of crimps (%) | Uniformity of dyeing | Touch: Bulkiness | Touch: Softness |
|---|---|---|---|---|---|---|---|---|
| 1 | 5 | 13.5 | 10.1 | 15.5/31.2 | 11 | 0.5 | ⊙-○ | ○ |
| 2 | 18 | 13.2 | 10.0 | 15.3/30.8 | 13 | 0.5 | ⊙-○ | ○ |
| 3 | 45 | 12.3 | 9.8 | 14.7/29.8 | 15 | 0.5 | ○-⊙ | ○ |

TABLE 3

| Sample No. | Maximum mesh spece of filter (μ) | Spinnability | Shrinkage forming ratio (%) | Shrinkage forming stress (mg/d) | Shrinkage forming after boiling water treatment: Numbers of crimps per 25 mm/ Degree of shrinkage (%) | Shrinkage forming after boiling water treatment: Relative standard deviation of numbers of crimps (%) | Uniformity of Dyeing | Touch: Bulkiness | Touch: Softness |
|---|---|---|---|---|---|---|---|---|---|
| 1 | 2 | ⊙ | 4.7 | 3.5 | 8.6/15.3 | 28 | 0.3 | X | Δ |
| 2 | 5 | ⊙ | 5.8 | 3.6 | 11.7/22.3 | 23 | 0.5 | Δ-X | Δ |
| 3 | 10 | ⊙ | 11.4 | 9.8 | 14.8/30.1 | 18 | 0.5 | ○ | ○ |
| 4 | 30 | ⊙ | 13.5 | 10.1 | 15.5/31.2 | 11 | 0.5 | ⊙-○ | ○ |
| 5 | 60 | ⊙-○ | 13.2 | 10.5 | 15.1/32.4 | 13 | 0.5 | ⊙-○ | ○ |

COMPARISON EXAMPLE 1

In the conditions of Example 1, except that either or both of the shrinkage forming and redrawing treatments on dried and dense filaments were not carried out as shown in Table 4 acrylic multi-layered conjugated fibers were obtained whose single filament denier was 3 (however, in this case, theoretical number of layers per fiber were 5.6).

Shrinkage forming ratio in boiling water, shrinkage forming stress, uniformity of dyeing, numbers of crimps after treating in boiling water, degree of shrinkage, relative standard deviation of numbers of crimps, and touch of the fibers obtained are shown in Table 4.

EXAMPLE 4

In the conditions of Example 1, shrinkage forming treating conditions for dried and dense filaments were changed as shown in Table 5. Other conditions were the same as those of Example 1 to obtain acrylic multi-layered conjugated fibers whose denier of single fibers was 3 denier (however, in this case, theoretical number of layers per fiber were 5.6).

Shrinkage forming ratio in boiling water, shrinkage forming stress, uniformity of dyeing, numbers of crimps after treating in boiling water, degree of shrinkage, relative standard deviation of numbers of crimps, and touch of the fibers obtained are shown in Table 5.

EXAMPLE 5

In the conditions of Example 1, redrawing conditions for dried and dense filaments after shrinkage forming treatment were changed as shown in Table 6. Other conditions were the same as those of Example 1 to obtain acrylic multi-layered conjugated fibers whose denier of single fibers was 3 denier (however, in this case, theoretical number of layers per fiber were 5.6).

Shrinkage forming ratio in boiling water, shrinkage forming stress, uniformity of dyeing, numbers of crimps after treating in boiling water, degree of shrinkage, relative standard deviation of numbers of crimps, and touch of the fibers obtained are shown in Table 6.

TABLE 4

| Sample No. | Shrinkage forming treatment | Redrawing treatment | Shrinkage forming ratio (%) | Shrinkage forming stress (mg/d) | Shrinkage forming after boiling water treatment: Numbers of crimps per 25 mm/ Degree of shrinkage (%) | Shrinkage forming after boiling water treatment: Relative standard deviation of numbers of crimps (%) | Uniformity of dyeing | Touch: Bulkiness | Touch: Softness |
|---|---|---|---|---|---|---|---|---|---|
| 1 | Yes | No | 0 | 1.8 | 12.8/27.9 | 17 | 0.5 | X | X X |
| 2 | No | Yes | 19.4 | 22.1 | 16.2/20.3 | 18 | 0.8 | Δ | X X |
| 3 | No | No | 1.2 | 3.6 | 8.9/25.4 | 13 | 0.5 | X | ○ |

TABLE 5

| Steam heating temperature | Shrinkage forming after boiling water treatment |
|---|---|

TABLE 5-continued

| Sample No. | for shrinkage forming treatment (°C.) | Shrinkage forming ratio (%) | Shrinkage forming stress (mg/d) | Numbers of crimps per 25 mm/Degree of shrinkage (%) | Relative standard deviation of numbers of crimps (%) | Uniformity of dyeing | Touch Bulkiness | Touch Softness |
|---|---|---|---|---|---|---|---|---|
| 1 | 105 | 11.6 | 9.5 | 12.4/27.8 | 9 | 0.2 | Δ | ⊙ |
| 2 | 108 | 12.8 | 10.1 | 14.5/29.6 | 12 | 0.5 | ○ | ○-⊙ |
| 3 | 113 | 13.6 | 10.3 | 15.2/31.3 | 12 | 0.5 | ⊙-○ | ○ |
| 4 | 118 | 14.0 | 11.5 | 16.1/33.4 | 14 | 0.5 | ⊙-○ | ○ |
| 5 | 125 | 12.8 | 12.4 | 18.2/34.1 | 15 | 0.8 | ○ | Δ |

TABLE 6

| Sample No. | Redrawing conditions: Steam heating temperature (°C.) | Redrawing conditions: Drawing ratio (times) | Shrinkage forming ratio (%) | Shrinkage forming stress (mg/d) | Shrinkage forming after boiling water treatment: Number of crimps per 25 mm/ Degree of shrinkage (%) | Shrinkage forming after boiling water treatment: Relative standard deviation of numbers of crimps (%) | Uniformity of dyeing | Touch Bulkiness | Touch Softness |
|---|---|---|---|---|---|---|---|---|---|
| 1 | 80 | 1.15 | 11.3 | 12.4 | 12.7/28.5 | 13 | 0.5 | ○ | ○ |
| 2 | 105 | 1.15 | 9.8 | 10.1 | 13.2/29.0 | 11 | 0.5 | ○-Δ | ⊙ |
| 3 | 102 | 1.05 | 8.7 | 8.5 | 13.9/29.3 | 12 | 0.5 | ○-Δ | ⊙ |
| 4 | 102 | 1.14 | 12.9 | 10.4 | 14.8/30.1 | 12 | 0.5 | ⊙-○ | ○-⊙ |
| 5 | 102 | 1.22 | 14.2 | 16.6 | 16.3/34.5 | 14 | 0.5 | ⊙ | ○ |

EXAMPLE 6

94.2 mole % of acrylonitrile, 5.5 mole % of methyl acrylate and 0.3 mole % of sodium methallyl-sulfonate were solution polymerized in DMSO to prepare a spinning dope (C) whose solution viscosity was 133 poises/60° C. and polymer concentration was 22.4 weight %.

On the other hand, 91.7 mole % of acrylonitrile, 8.0 mole % of methyl acrylate and 0.3 mole % of methallyl-sulfonate were solution polymerized in the same way to prepare a spinning dope (D) whose solution viscosity was 124 poises/60° C. and polymer concentration was 22.2 weight %.

Equal quantities of the above described two types of spinning solutions, (C) and (D) were guided to a "Static mixer" (pitch of the mixing element L/D 1.5) equipped with a guiding device 1 for a spinning dope inlet hole as shown in FIG. 4 and thereby divided into inflow dope layers, which were then spun out from a normal rectangular spinneret plate having round holes of 0.065 mmϕ diameter through a filter prepared of a polyester plain gauge fabric (of maximum mesh space about 30 μm) placed just before the spinneret into a coagulation bath consisting of DMSO 55 weight % aqueous solution to coagulate them. In this example, theoretical number of layers per fiber as shown in Table 7 could be obtained by adjusting the laminated stage number of the mixing elements and numbers of holes of the spinneret. The spinning draft was 0.5 and the take-up speed of the coagulated filaments (the spinning speed) was 10 m/minute in this example.

The coagulated filaments were drawn by 6.5 times in hot water at 98° C. and the drawn filaments were then dried to densify them at 160° C. after washing sufficiently with warm water. These dried and densified filaments were successively treated under relaxed State in steam heating at 113° C. to cause shrinkage.

Next, the crimps were removed by redrawing these shrunk filaments by 1.17 times at 102° C. of steam heating temperature and thereafter mechanical crimps of about 11 peaks/25 mm were given to the filaments by means of a pushing-in type crimper and the filaments were then dried with hot air at 70° C. to obtain acrylic multi-layered conjugated fibers whose denier of single fibers was 3 denier.

Shrinkage forming ratio in boiling water, shrinkage forming stress in dry heating, shrinkage forming retention property, numbers of crimps per unit length after treating in boiling water, degree of shrinkage, relative standard deviation of numbers of crimps per unit length, uniformity of dyeing and touch of the fibers thus obtained were evaluated and the results are shown in Table 7.

As these results show, fibers of the present invention have high shrinkage forming characteristics and excellent. bulkiness and touch (high bulk and soft touch) as well as good level dyeing property when dyed.

TABLE 7

| No. | Theoretical number of layers per fiber | Divided layer numbers of inflow spinning dopes (Layers) | Numbers of holes of spinneret | Shrinkage forming ratio (%) | Shrinkage forming stress (mg/d) | Shrinkage forming retention (%) | Shrinkage forming after boiling water treatment: Numbers of crimps per 25 mm/ Degree of shrinkage (%) | Shrinkage forming after boiling water treatment: Relative standard deviation of numbers of crimps (%) | Uniformity of dyeing | Touch Bulkiness | Touch Softness |
|---|---|---|---|---|---|---|---|---|---|---|---|
| 1 | 4.7 | 256 | 3,000 | 10.3 | 9.6 | 51 | 14.1/30.0 | 15 | 0.6 | ○-⊙ | ○ |
| 2 | 6.6 | 256 | 1,500 | 12.9 | 10.3 | 60 | 13.4/28.5 | 13 | 0.5 | ⊙-○ | ○-⊙ |
| 3 | 9.3 | 512 | 3,000 | 12.1 | 10.0 | 57 | 13.1/26.1 | 13 | 0.5 | ⊙-○ | ○-⊙ |
| 4 | 13.2 | 512 | 1,500 | 11.4 | 9.8 | 53 | 12.7/24.5 | 11 | 0.3 | ○-⊙ | ○ |

EXAMPLE 7

92.2 mole % of acrylonitrile, 7.5 mole % of methyl acrylate and 0.3 mole % of sodium methallyl-sulfonate were solution polymerized in DMSO to prepare a spinning dope (E) whose solution viscosity was 130 poises/60° C. and polymer concentration was 22.5 weight %.

On the other hand, 97.2 mole % of acrylonitrile, 2.0 mole % of methyl acrylate and 0.8 mole % of sodium methallyl-sulfonate were solution polymerized in the same way to prepare a spinning dope (F) whose solution viscosity was 125 poises/60° C. and polymer concentration was 22.3 weight %.

Equal quantities of the above described two types of spinning dopes (E) and (F) were guided to a "Static mixer" (theoretical number of layers per fiber was 5.6) equipped with a guiding device I of a spinning dope inlet hole as shown in FIG. 4 and thereby divided into inflow dope layers, which were then spun out from a normal rectangular spinneret plate with triangle holes of 0.13 mm in each side length through a filter prepared of a polyester plain gauge fabric (maximum mesh space about 30 μm) being placed just before the spinneret into a coagulation bath consisting of DMSO 55 weight % aqueous solution at 30° C. to obtain coagulated filaments.

The spinning draft was 1.13 and the take-up speed of the coagulated filaments (the spinning speed) was 5 m/minutes.

The coagulated filaments were drawn by 6.0 times in hot water at 98° C. and the drawn filaments were then dried to densify them at 160° C.

These dried and dense filaments were successively treated under relaxed state in steam heating at 113° C. to cause shrinkage.

Next, the crimps were removed by redrawing these shrunkage filaments by 1.15 times at 102° C. of steam heating temperature and thereafter mechanical crimps of about 11 peaks/25 mm were imparted to the filaments by means of a pushing-in type crimper and the resultant filaments were dried with hot air at 70° C. to obtain fibers whose monofilament denier was 3.5 denier and cross-section was triangular.

Tensile strength and elongation, knot strength, shrinkage forming ratio in boiling water, shrinkage forming stress in dry heating, numbers of crimps per unit length after treating in boiling water, coloring property, density, luster and touch (bulkiness and linen-like dry touch) of the fibers obtained were evaluated and shown in Table 8.

ning dope (G) whose solution viscosity was 130 poises/60° C. and polymer concentration was 22.5 weight %.

This spinning dope (G) was spun out from a normal rectangular spinneret plate with triangular holes of 0.13 mm in each side length in the same way as the preceding Example 7 except no "Static mixer" and no existence of a filter prepared of a polyester plain gauge fabric placed just before the spinneret to obtain fibers of triangle cross-section whose monofilament denier is 3.5 denier.

Characteristics of fibers obtained are showen in Table 8 in parallel. As these results show, fibers of the present invention had excellent tensile strength and elongation characteristics, especially excellent knot strength as well as excellent luster and coloring property in comparison with those of the conventional modified cross-sectional fibers. As the fibers of the present invention have a multi-layered structure, the fibers of the present invention exhibited excellent shrinkage forming characteristics which the conventional fibers did not have, as well as unique bulkiness and linenlike dry touch and as a whole, the quality was excellent.

EXAMPLE 8

97.3 mole % of acrylonitrile, 2.0 mole % of methyl acrylate and 0.7 mole % of sodium methallyl-sulfonate were solution polymerized in DMSO to prepare a spinning dope (m) whose solution viscosity was 118 poises/60° C. and polymer concentration was 21.9 weight %.

On the other hand, 91.5 mole % of acrylonitrile, 8.3 mole % of methyl acrylate and 0.3 mole % of sodium methallyl-sulfonate were solution polymerized in the same way to prepare a spinning dope (I) whose solution viscosity was 125 poises/60° C. and polymer concentration was 22.5 weight %.

The temperatures of the above described two types of spinning dopes (H) and (I) were adjusted to 30° C. and equal quantities thereof were guided to a "Static mixer" (pitch of the mixing element L/D 1.5) equipped with a guiding device 1 of a spinning dope inlet hole as shown in FIG. 4 and thereby divided into inflow dope layers, which were then spun out from a normal rectangular spinneret plate having round holes of 0.065 mmϕ diameter through a filter prepared of a polyester plain gauge fabric (maximum mesh space about 30 μm) placed just before the spinneret into a coagulation bath consisting of DMSO 55 weight % aqueous solution to coagulate them. In this example, theoretical number of layers per fiber as shown in Table 9 could be obtained by properly adjusting laminated stage numbers of the mixing elements and numbers of holes of the spinneret.

TABLE 8

| | Tensile strength (g/d)/ Elongation (%) | Knot strength (g/d) | Shrinkage forming ratio (%) | Shrinkage forming stress (mg/d) | Numbers of crimps per 25 mm after boiling water treatment/ Degree of shrinkage (%) | Coloring property (K/S) | Density | Luster | Touch | |
|---|---|---|---|---|---|---|---|---|---|---|
| | | | | | | | | | Bulkiness | Linen-like dry touch |
| Example No. 1 | 3.58/35.2 | 2.13 | 11.8 | 17.5 | 14.8/36.2 | 0.52 | Good | Good | ⊙ | ⊙ |
| Comparison example | 3.16/28.4 | 1.68 | — | — | — | 0.41 | A little poor | A little poor | X X | Δ |

COMPARISON EXAMPLE 2

94.2 mole % of acrylonitrile, 5.5 mole % of methyl acrylate and 0.3 mole % of sodium methallyl-sulfonate were solution polymerized in DMSO to prepare a spin- The spinning draft was 0.65 and the take-up speed of the coagulated filaments (the spinning speed) was 12 m/minute.

The coagulated filaments were drawn by 5.0 times in hot water at 98° C. and the drawn filaments were then dried to densify them at 170° C. after washing them with warm water. These dried and dense filaments were successively treated under relaxed state in steam heating at 110° C. to cause shrinkage.

Next, the crimps were removed by redrawing these shrunk filaments by 1.13 times at 102° C. of steam heating temperature and thereafter mechanical crimps of about 11 peaks/25 mm were given to the filaments by means of a pushing in type crimper and the filaments were dried to obtain acrylic multi-layered conjugated fibers whose single fiber denier was 3 denier.

Shrinkage forming ratio in boiling water, shrinkage forming stress in dry heating, uniformity of dyeing, knot strength after treating in boiling water, numbers of crimps, degree of shrinkage and touch were evaluated and shown in Table 9.

As these results show, said fibers having a multi-layered structure whose layers were above 2 iii average were pilling-resistant conjugated fibers exhibiting good shrinkage characteristics and excellent touch (bulkiness and soft feeling).

The spinning draft was 0.58 and the take-up speed of the coagulated filaments (the spinning speed) was 10 m/minute.

The coagulated filaments were drawn by 5.5 times in hot water at 98° C. and the drawn filaments were then dried to densify them at 160° C. after washing them with warm water.

These dried and dense filaments were pressed into a pushing-in type crimper to give them mechanical crimps of about 11 peaks/25 mm and then dried with hot air at 70° C. to obtain acrylic fibers whose single fiber denier was 3 denier.

Next, the above described fibers were treated to give hydrophilic property and crosslinking with sodium carbonate 20 g/l aqueous solution at 98° C. for 30 minutes and then boiled in hot water at 90° C. for 10 minutes after washing.

Tensile strength and elongation, water retention ratio, numbers of crimps, degree of shrinkage, coalescent property and bulkiness of the fibers obtained were evaluated and shown in Table 10.

On the other hand, for comparison, acrylic fibers whose single fiber denier was 3 were prepared by spinning the spinning dope (J) only in the wet spinning process and thereafter by treating the fibers to give hydrophilic property and crosslinking in the same way as the above described conditions. Tensile strength and elongation, water retention ratio, numbers of crimps, degree of shrinkage, coalescent property and bulkiness of the fibers obtained were evaluated and shown in Table 10 in parallel. In this case, sodium carbonate 10 g/l aqueous solution was used for the treatment for giving hydrophilic property and crosslinking.

As these results showed- the fibers of the present invention in which an acrylic polymer containing carboxylic acid groups and another acrylic polymer which is not an acrylic polymer containing carboxylic acid groups made a multi-layered structure of 2 or more layers along the fiber axis, exhibited little decrease in tensile strength and elongation, excellent water retention like the conventional water swollen fibers, no coalescence and good bulky touch.

TABLE 9

| Sample No. | Theoretical number of layers per fiber | Divided layer numbers of inflow spinning dopes (Layers) | Numbers of holes of spinneret | Shrinkage forming ratio (%) | Shrinkage forming stress (mg/d) | Characteristics after boiling water treatment: Knot strength (g/d) | Characteristics after boiling water treatment: Numbers of crimps per 25 mm/Degree of shrinkage (%) | Uniformity of dyeing | Touch: Bulkiness | Touch: Softness |
|---|---|---|---|---|---|---|---|---|---|---|
| 1 | 4.7 | 256 | 3,000 | 13.1 | 9.8 | 1.58 | 16.2/31.5 | 0.8 | ○-◎ | ○-◎ |
| 2 | 6.6 | 256 | 1,500 | 13.7 | 10.2 | 1.50 | 15.9/30.8 | 0.8 | ○-◎ | ◎-○ |

EXAMPLE 9

95.2 mole % of acrylonitrile, 3 mole % of itaconic acid, 1.5 mole % of methyl acrylate and 0.3 mole % of sodium methallyl- sulfonate were solution polymerized in DMSO to prepare a spinning dope (J) whose solution viscosity was 120 poises/60° C. and polymer concentration was 21.8 weight %.

On the other hand, 94.0 mole % of acrylonitrile, 5.5 mole % of methyl acrylate and 0.5 mole % of sodium methallyl-sulfonate were solution polymerized in the same way to prepare a spinning dope (K) whose solution viscosity was 125 poises/60° C. and polymer concentration was 22.3 weight %.

Equal quantities of the above described two types of spinning dopes (i) and (K) were guided to a "Static mixer" (pitch of the mixing element L/D 1.5) equipped with a guiding device 1 of a spinning dope inlet hole as shown in FIG. 4 and thereby divided into inflow dope layers, which were then spun out from a normal rectangular spinneret plate having round holes of 0.065 mmϕ diameter through a filter prepared of a polyester plain gauge fabric (maximum mesh space about 30 μm) placed just before the spinneret into a coagulation bath consisting of DMSO 55 weight % aqueous solution to coagulate them. In this example, theoretical number of layers per fiber as shown in Table 10 could be obtained by properly adjusting laminated stage numbers of the mixing elements and numbers of holes of the spinneret.

EXAMPLE 10

94.2 mole % of acrylonitrile, 5.5 mole % of methyl acrylate and 0.3 mole % of sodium methallyl-sulfonate were solution polymerized in DMSO to prepare a spinning dope (L) whose solution viscosity was 193 poises/60° C. and polymer concentration was 22.5 weight %.

On the other hand, 91.2 mole % of acrylonitrile, 8.5 mole % of methyl acrylate and 0.3 mole % of sodium methallyl-sulfonate were solution polymerized in the same way to prepare a spinning dope (M) whose solution viscosity was 198 poises/60° C. and polymer concentration was 22.3 weight %.

Equal quantities of the above described two types of spinning dopes (L) and (M) were guided to a "Static mixer" (theoretical number of layers per fiber was 6.6) equipped with a guiding device 1 of a spinning dope inlet hole as shown in FIG. 4 and thereby divided into inflow dope layers, which were then spun out once into air from a normal rectangular spinneret plate having 1,500 round holes whose diameter was 0.12 mmϕ through a filter prepared of a polyester plain gauge fabric (maximum mesh space about 30 μm) placed just before the spinneret, passed through air over a distance of 10 mm and introduced into a coagulation bath consisting of DMSO 55 weight % aqueous solution at 15° C. to prepare coagulated filaments.

TABLE 10

| No. | Theoretical number of layers per fiber | Tensile strength (g/d)/ Elongation (%) | Water retention ration (%) | Shrinkage forming ratio (%) | Shrinkage forming stress (mg/d) | Numbers of crimps per 25 mm/Degree of shrinkage (%) (After boiling water treatment) | Coloring property (K/S) | Coalescence | Bulkiness | Notice |
|---|---|---|---|---|---|---|---|---|---|---|
| 1 | 5.6 | 2.8/27 | 166 | 9.4 | 15.8 | 28.5/39.4 | 0.41 | No | Good | Present invention |
| 2 | 11.2 | 2.9/28 | 168 | 8.6 | 14.0 | 23.8/32.9 | 0.42 | No | Good | Present invention |
| 3 | — | 1.8/62 | 161 | — | — | — | 0.18 | A little | Poor | Conventional |

The coagulated filaments were successively introduced into hot water at 98° C. and drawn by 6.5 times. The drawn filaments were washed sufficiently with warm water and thereafter dried at 160° C. to densify them.

These dried and dense filaments were successively treated under relaxed state in steam heating at 113° C. to cause shrinkage.

Next, the crimps were removed by redrawing these shrunk filaments by 1.13 times at 102° C. of steam heating temperature and thereafter mechanical crimps of about 11 peaks/25 mm were given to the filaments by means of a pushing-in type crimper and the filaments were dried with hot air at 70° C. to obtain conjugated fibers whose single fiber denier was 3 denier.

Numbers of crimps, degree of shrinkage, uniformity of dyeing, smoothness of single fiber surface and touch were evaluated and shown in Table 11.

As these results show, the fibers obtained by the method of the present invention exhibited an animal fur tone touch which had both very soft and dry slime touch and flexible and tough elasticity.

TABLE 11

| Spinning process | Numbers of crimps per 25 mm/Degree of shrinkage (%) (After boiling water treatment) | Smoothness of surface of single fiber | Uniformity of dyeing | Flexible elasticity | Cashimire touch by hand | Bulkiness |
|---|---|---|---|---|---|---|
| Dry jet wet spinning | 9.5/23.3 | ⊙ | 0.4 | ⊙ | ⊙ | ○ |

We claim:

1. A method for the production of a multi-layered conjugated acrylic fiber, which fiber has a shrinkage forming ratio in boiling water of 7–15%, and has a shrinkage forming stress in dry heat of 5–20 mg per denier, comprising dividing two or more spinning dopes of acrylic polymers into layers, said polymers containing 80 mol % or more of acrylonitrile, said polymers being made essentially from the same two monomers, and the maximum difference in the molar ratio of the copolymerizable component being between 1 and 10 mole %, wherein the theoretical number of layers per fiber as defined by the following equation is 3–30:

$$\text{Theoretical number of layers per fiber} = \frac{\text{Divided layer numbers in the spinning dope flow}}{K\sqrt{\text{Numbers of holes in the spinneret}}}$$

(where K is a constant determined by the outer shape of the spinneret plate)

introducing the dope into the spinneret through a filter whose maximum mesh space is 10 μm or more to maintain an interface of said divided dopes, spinning out the dope to form a multi-layered conjugated acrylic fiber, thereafter coagulating, drawing, washing, drying carrying out a shrinkage forming treatment on and redrawing the fiber obtained.

2. A method for the production of a multi-layered conjugated acrylic fiber as claimed in claim 1, wherein the viscosity differences of the two or more spinning dopes of acrylic polymers are adjusted to 50 poises/60° C. or less.

3. A method for the production of a conjugated acrylic fiber as claimed in claim 1 or claim 2, wherein the filter, whose maximum mesh space is 10 μm or more, has a lattice-shaped structure.

4. A method for the production of a conjugated acrylic fiber as claimed in claim 1 or claim 2, wherein the shrinkage forming treatment is a heat treatment under relaxed state in steam heating at 105° C. or more and the redrawing treatment is a drawing treatment by 1.05–1.25 times in wet or steam heating at 80° C. or more and below the shrinkage forming treating temperature.

5. A method for the production of a conjugated acrylic fiber, which fiber has a shrinkage forming ratio in boiling water 7–15%, and has a shrinkage forming stress in dry heat of 5–20 mg per denier, comprising dividing two or more spinning dopes of acrylic polymers, said polymers containing 80 mole % or more of acrylonitrile, said polymers being made essentially from the same two monomers, and the maximum difference in the molar ratio of the copolymerizable component being between 1 and 10 mole %, wherein at least one acrylic polymers contains 0.3–2.0 m mole/g of carboxylic acid groups, into layers wherein theoretical layer numbers of single fibers as defined by the following equation is 3–30:

$$\text{Theoretical number of layers per fiber} = \frac{\text{Divided layer numbers of the spinning dope flow}}{K\sqrt{\text{Number of holes in the spinneret}}}$$

(where K is a constant determined by the outer shape of the spinneret plate)

introducing the dope into the spinneret through a filter whose maximum mesh space is 10 μm or more to maintain an interface of said divided dopes, spinning out the dope to form a multi-layered conjugated acrylic fiber, thereafter coagulating, drawing, washing and drying the fiber obtained and finally treating the fiber in an alkali solution.

6. A method for the production of a conjugated acrylic fiber as claimed in any claims 1 or 2, wherein dry jet wet spinning is carried out.

7. A method for the production of a conjugated acrylic fiber as claimed in claim 5, wherein dry jet wet spinning is carried out.

* * * * *